United States Patent [19]

Ascroft

[11] Patent Number: 4,776,123

[45] Date of Patent: Oct. 11, 1988

[54] SAFETY PLUG FOR FIRING CHAMBERS OF GUNS

[76] Inventor: Ralph W. Ascroft, 3325 Oakshire, Berkley, Mich. 48072

[21] Appl. No.: 106,594

[22] Filed: Oct. 13, 1987

[51] Int. Cl.[4] ..... F41C 17/00

[52] U.S. Cl. ..... 42/70.11; 42/96

[58] Field of Search ..... 42/96, 70.11

[56] References Cited

U.S. PATENT DOCUMENTS

| | | | |
|---|---|---|---|
| 2,530,560 | 11/1950 | Young | 42/70.11 |
| 2,985,979 | 5/1961 | Doyle et al. | 42/70.11 |
| 3,154,874 | 11/1964 | Stewart | 42/70.11 |
| 3,193,959 | 7/1965 | Jaycox | 42/96 |
| 3,444,639 | 5/1969 | Rockwood | 42/70.11 |
| 3,553,877 | 1/1971 | Welch et al. | 42/70.11 |
| 3,673,725 | 7/1972 | Cravener | 42/70.11 |
| 3,678,609 | 7/1972 | Fazio | 42/96 |
| 4,014,123 | 3/1977 | Williams | 42/70.11 |
| 4,398,366 | 8/1983 | Wernicki | 42/70.11 |
| 4,512,099 | 4/1985 | Mathew | 42/70.11 |

*Primary Examiner*—Deborah L. Kyle
*Assistant Examiner*—Michael J. Carone
*Attorney, Agent, or Firm*—Gifford, Groh, VanOphem, Sheridan, Sprinkle and Dolgorukov

[57] ABSTRACT

A safety device for use with a gun of a type which fires a conventional cartridge casing having an annular rim portion which cooperates with an ejector mechanism of the gun to unload the cartridges. The safety device includes a body portion having a neck portion extending from one end and a rear portion at an other end. The plug is inserted into a firing chamber of a gun with the neck portion extending into a bore of a barrel of a gun. The neck portion has a diameter slightly greater than the inner diameter of the bore to provide a press fit. The rear portion of the plug has a cylindrical portion having a diameter less than the diameter of the annular rim portion of a suitable cartridge casing such that the ejector mechanism of the gun cannot engage and eject the plug from the firing chamber. The plug is, thus, fixedly inserted into the firing chamber of the gun so that the gun cannot be accidentally loaded or fired.

7 Claims, 1 Drawing Sheet

SAFETY PLUG FOR FIRING CHAMBERS OF GUNS

BACKGROUND OF THE INVENTION

I. Field of the Invention

This invention relates to a safety device for preventing the loading and firing of firearms and more particularly for use with firearms having devices for engaging and/or ejecting cartridge casings.

II. Description of the Prior Art

Many safety devices for preventing the firing of firearms are known. Locking devices having a lever movable in response to the operation of a key or combination to selectively prevent release of the safety are known, such as the device disclosed in U.S. Pat. No. 3,553,877 to Welch et al. However, locking devices of this type require modification of the gun to permit installation of the devices. Such devices are also complicated and relatively expensive.

Locking devices, such as disclosed in U.S. Pat. No. 4,512,099 to Mathew, having a tube which is inserted through a muzzle and locked into a gun barrel, are known. A pair of wedges is attached to one end of the tube and a cylinder lock is positioned at an other end. The wedges are inserted through the barrel into a firing chamber of a gun with a cylinder lock extending out of the muzzle. The wedges are laterally displaceable within the firing chamber by action of the lock to prevent the displacement of the device from the gun, thereby preventing the loading of ammunition. Locking devices of this type are relatively large, cumbersome and expensive.

Therefore, it would be desirable to have a safety device which is inexpensive and easy to use, does not require modification of the gun, and permits actuation of the firing mechanism of the gun while positively preventing the accidental firing of the gun.

SUMMARY OF THE INVENTION

It is therefore an object of this invention to provide an inexpensive and effective device for disarming a firearm.

It is a further object of the invention to provide a safety device which prevents loading of ammunition into a firing chamber of a gun.

It is another object of the invention to provide a safety device which permits operation of the firing mechanism while positively preventing the loading of ammunition into the gun.

It is a further object of the invention to provide a safety device which is in the form of a plug which cannot be ejected from the firing chamber of a gun by an ejection mechanism.

In order to accomplish these and other objectives, Applicant dicloses a safety device for use with a gun of a type which fires a conventional cartridge casing having an annular rim portion which cooperates with an ejector mechanism of the gun to unload cartridges. The safety device includes a plug having a body having a neck portion extending from one end and a rear portion at an other end. The plug is fixedly inserted into a firing chamber of the gun so that the gun cannot be loaded and accidentally fired.

The plug is inserted into a firing chamber of the gun with the neck portion extending into a bore of a barrel. The neck portion has a diameter slightly greater than the inner diameter of the bore to provide a press fit. The rear portion of the plug has a cylindrical portion extending axially from the body portion and having a diameter less than a diameter of the annular rim portion of a suitable cartridge casing. The rear portion of the plug is positioned within the chamber to form a void in the area normally occupied by the annular rim of a conventional cartridge. Thus, the ejector mechanism of the gun cannot engage and eject the plug from the firing chamber. The plug may be formed of a resilient material with a flat rear surface. The resilient rear surface is positioned to permit striking of the rear surface by the firing pin.

DETAILED DESCRIPTION

Figure 1:
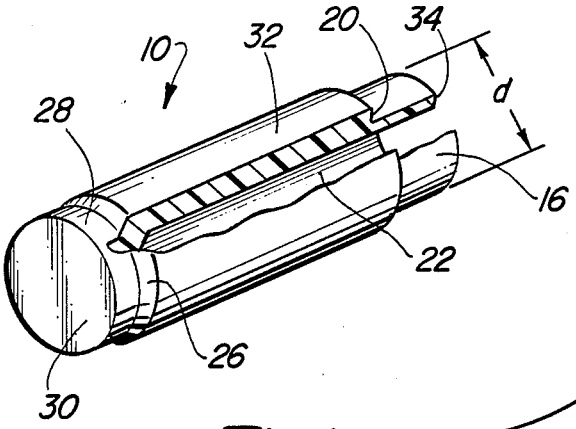
FIG. 1 is a perspective view of a safety device suitable for use in guns such as rifles.
Figure 2:
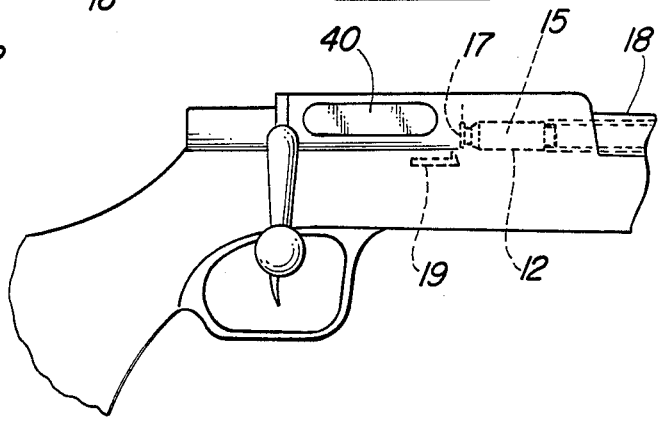
FIG. 2 is a fragmentary side view of a rifle showing a conventional cartridge in place in a firing chamber.
Figure 3:
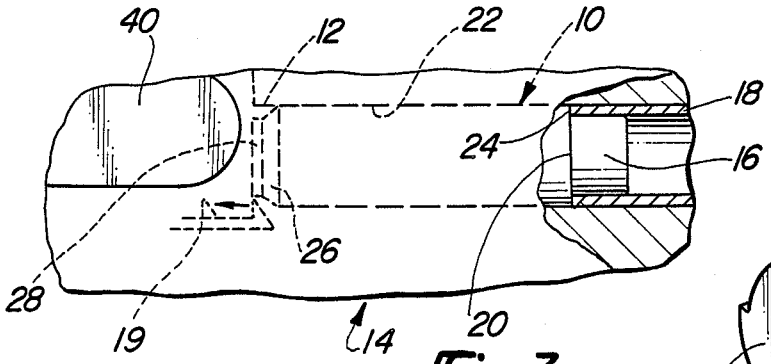
FIG. 3 is an enlarged fragmentary sectional view of the firing chamber and barrel of the rifle of FIG. 2 with the safety device in position.

Applicant's safety device, as shown in FIGS. 1 and 3, is an elongated plug 10 adapted to be inserted into the firing chamber 12 of a rifle 14. The plug is inserted in the same manner as a conventional cartridge casing 15 is loaded as shown in FIG. 2. The cartridge is loaded into the firing chamber with a rim 17 projecting radially. The rim is adapted to be engaged by a head of an ejector lever 19 to remove the cartridge casing. The plug 10 has a cylindrical neck portion 16 extending at one end and having an outer diameter "d" slightly greater than the inner diameter of a barrel 18 of the rifle for a press fit of the plug into the barrel. Insertion of the plug 10 into the firing chamber is limited by an annular shoulder surface 20 which extends between the neck portion 16 and a cylindrical body 22 portion for abutment against an end surface 24 of the firing chamber 12. The cylindrical body portion 22 is dimensioned to be received within the firing chamber 12 of the rifle with a diameter generally the same as that of a suitable conventional cartridge. The body portion 22 may be cylindrical or tapered, as required, and extends axially from the shoulder surface to a tapered surface 26. The tapered surface 26 extends outwardly from the body and tapers radially inwardly to a cylindrical end portion 28. The end portion 28 is positioned in the firing chamber 12 adjacent to a lever 30 of an ejector mechanism. A rear surface 30 across the end portion 28 normal to the longitudinal axis of the plug.

In the preferred embodiment, the plug 10 is formed with a cavity 32, as shown in FIG. 1, extending axially from an opening 34 in the neck portion 16 towards the rear surface. The opening is defined by a flat annular surface 36. The plug 10 may be formed of any suitable resilient material, such as nylon or plastic by extrusion or injection molding.

As shown in FIGS. 2 and 3, the rifle is disarmed by inserting the plug 10 through an opening 40 of the rifle into the firing chamber 12. The neck portion 16 of the plug 10 is pushed into the barrel 18 until the shoulder surface 20 abuts the end 24 of the firing chamber. Some force is required to press fit the plug properly into position within the firing chamber. The end portion 28 is thus located in a position where a rim portion of a suitable casing would normally be located. The diameter of the end portion of the plug is sufficiently less than the diameter of the rim, so that that no material extends into the area normally occupied by the rim of the cartridge casing. Thus, the ejector lever cannot engage the plug 10 to accidentally remove or eject the plug 10 from the firing chamber 12.

Once the plug 10 has been inserted into the firing chamber 12, the firing mechanism (not shown) of the rifle can be operated so that a firing pin will strike the rear surface 30 of the plug 10. Because the rear surface 30 is formed of a resilient material, the plug 10 will absorb the impact without damage to the pin. In this way, the rifle may be test fired in a store or manufacturing plant to obtain a feel for the firing mechanism and insure its operation without concern of accidental firing.

After the plug 10 has been press fit into position, the plug 10 will remain fixed in the firing chamber 12. The plug 10 may be removed by inserting a suitable rod (not shown) down the barrel from the muzzle towards the firing chamber to engage a portion of the annular surface 36 of the plug. By applying a force to the rod, the plug 10 may be directed rearwardly out of the firing chamber 12.

Figure 5:
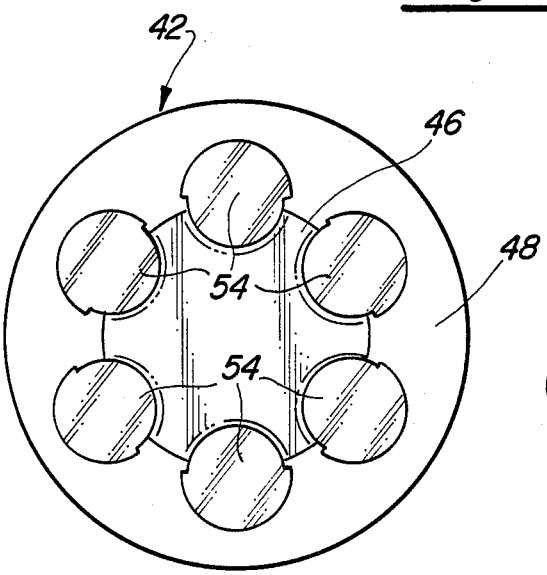
FIG. 5 is an end view of a cylinder of a revolver showing safety plugs in accordance with the invention in position in the cylinder.
Figure 6:
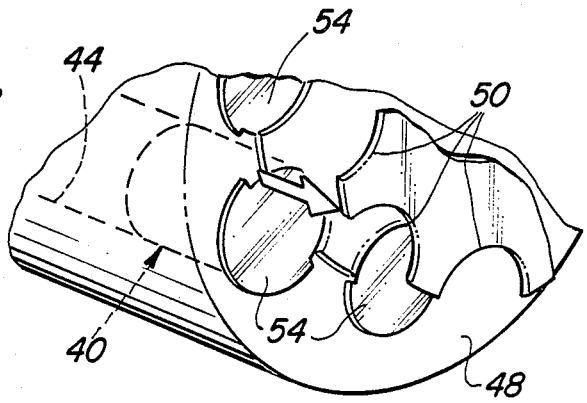
FIG. 6 is a exploded partial perspective view of a cylinder having an ejector mechanism in an unloading position.

The safety device may be adapted for use in a revolver. As shown in FIG. 6, a revolver cylinder 42 of a revolver has longitudinal bores 44 for loading cartridges. An ejector plate 46 shown in FIGS. 5 and 6 is movable rearwardly (as indicated by arrow A) from a rear surface 48 of the cylinder to engage the rim of a conventional cartridge casing and displace the casing from each of the bores. The ejector plate 48 has a plurality of semi-circular notches 50 positioned about the periphery of the ejector plate to permit loading of the cartridge into each bore.

Figure 4:
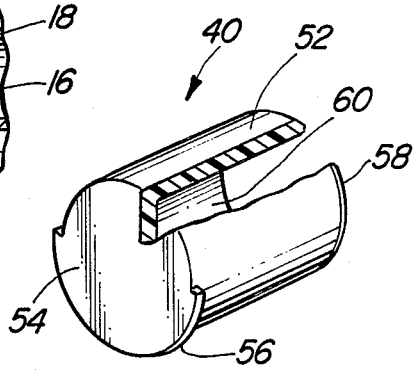
FIG. 4 is a perspective view of an alternative embodiment of the safety device suitable for use with revolvers.

A safety device according to the invention includes a cylindrical plug 40 as best shown in FIG. 4. The plug 40 has a cylindrical body 52 having a flat surface 54 at one end and a flange 56 extending partially around a circumference of the flat surface 54. The flange 56 extends slightly less than half of the circumference of the body 52 or flat surface 54 of the plug. The cylindrical body 52 of the plug has a diameter slightly larger than the diameter of the bores 44 of the cylinder 42 for a press fit with the bore. As shown in FIG. 6, a beveled surface 58 is formed at an opposite end of the body 42 to facilitate insertion of the plug 40 into each bore. A cavity 60 extends from the beveled surface axially towards the flat surface 54 of the plug. The plug may be formed of any resilient moldable material such as nylon or plastic.

As shown in FIG. 5, plugs 40 are inserted into the bores of the cylinder with the flange portion 56 extending along the rear surface 48 of the cylinder 42. The plug is positioned so that the flange portion 56 does not extend over the ejector plate 46 so that the plug is not removed when the ejector plate is moved rearwardly. The plug may be removed from the cylinder by inserting a rod into the front side of the cylinder and forcing the plug rearwardly out of the bore of the cylinder.

It should be apparent to those skilled in the art that the safety device can be adapted for use in most guns and is not limited to specific embodiments disclosed herein. It is within the contemplation of the invention to provide a plug which may be used with guns provided with a rod positioned to eject a cartridge by contacting the interior of the rear surface and dislodging the shell. Plugs for this type of gun would be provided with an aperture in the rear surface to accept the rod therethrough to prevent ejection of the plug.

The invention may be adapted to a variety of cartridge configurations such as those having a neck portion slightly smaller than the diameter of the body or equivalent to the body of the plug and that the rear end portion may have the same or slightly smaller diameter as the body. These and other manifestations of the preferred embodiment may be made within the scope of the present invention.

I claim:

1. A safety device for preventing the loading of a cartridge into a gun, said cartridge having an annular rim portion having a first predetermined diameter, said gun having a chamber for accepting said cartridge for firing and a barrel having a bore having a second predetermined diameter, said bore communicating with said chamber, said gun having an ejector member and a firing pin, said ejector member engaging said rim portion for ejecting said cartridge, said safety device comprising:

a plug adapted to be received within said chamber of said gun, said plug including a body having a cylindrical neck portion at one end and a cylindrical rear portion at an other end, said rear portion having a flat surface extending normal to a longitudinal axis of said plug and adapted to contact said firing pin when said gun is fired, said neck portion having a third predetermined diameter slightly larger than said second predetermined diameter of said bore, said neck portion being press fit into said bore, said body being adapted to be freely received in said firing chamber, said rear end portion having a fourth predetermined diameter less than said first predetermined diameter of said cartridge such that said ejector member of said gun does not contact said plug.

2. The safety device as claimed in claim 1 having a cavity axially extending from said neck portion into said body of said plug.

3. The safety device as claimed in claim 2 wherein said body has a fifth predetermined diameter.

4. The safety device as claimed in claim 3 wherein said fourth predetermined diameter of said cylindrical rear portion is less than said fifth predetermined diameter of said body.

5. The safety device as claimed in claim 3 wherein said second predetermined diameter of said bore is less than said fifth predetermined diameter of said body.

6. The safety device as claimed in claim 1 wherein said plug is formed of a resilient material.

7. A safety device for preventing the loading of a cartridge into a gun, said cartridge having an annular rim portion having a first predetermined diameter, said gun having a chamber for accepting said cartridge for firing, said chamber having a second predetermined diameter, said gun having a firing pin and a movable ejector member engaging said rim portion for ejecting said cartridge, said safety device comprising:

a body having a rear end portion having a cylindrical surface and a rim portion, said body and said cylindrical surface having a third predetermined diameter slightly larger than said second predetermined diameter of said chamber, said body being press fit into said chamber, said rim portion having a fourth predetermined diameter, said fourth predetermined diameter being greater than said third predetermined diameter, said rim portion extending radially outwardly from said rear portion encircling less than half of the circumference of said body, said rim portion engaging said gun to retain said plug in position within said chamber, said plug being mountable within said chamber with said cylindrical surface being adjacent to said ejector member, such as to permit free clearance of said ejector member when said ejector member is moved.

* * * * *